US008602407B2

(12) United States Patent
Ukai

(10) Patent No.: US 8,602,407 B2
(45) Date of Patent: Dec. 10, 2013

(54) SHEET FEEDING DEVICE AND SEPARATION UNIT

(71) Applicant: Shinji Ukai, Ichinomiya (JP)

(72) Inventor: Shinji Ukai, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/627,639

(22) Filed: Sep. 26, 2012

(65) Prior Publication Data

US 2013/0134653 A1 May 30, 2013

(30) Foreign Application Priority Data

Nov. 30, 2011 (JP) ..... 2011-262887

(51) Int. Cl.
*B65H 3/52* (2006.01)

(52) U.S. Cl.
USPC ..... 271/121

(58) Field of Classification Search
USPC ..... 271/121
See application file for complete search history.

(56) References Cited

U.S. PATENT DOCUMENTS

| | | | | |
|---|---|---|---|---|
| 5,573,338 | A * | 11/1996 | Morikawa et al. | 400/611 |
| 7,841,592 | B2 * | 11/2010 | Wu et al. | 271/121 |
| 2006/0082043 | A1 * | 4/2006 | Ikeda | 271/121 |
| 2006/0255526 | A1 * | 11/2006 | Ginzton | 271/121 |
| 2007/0222139 | A1 * | 9/2007 | Hotani | 271/121 |
| 2012/0126476 | A1 * | 5/2012 | Sheng | 271/121 |
| 2012/0146281 | A1 * | 6/2012 | Nishii et al. | 271/110 |

FOREIGN PATENT DOCUMENTS

| | | |
|---|---|---|
| JP | 64-9930 | 1/1989 |
| JP | 02-66534 | 5/1990 |
| JP | 05-186081 | 7/1993 |
| JP | 09-278212 | 10/1997 |
| JP | 2000-327156 | 11/2000 |
| JP | 2005-187105 | 7/2005 |
| JP | 2009-51629 | 3/2009 |

* cited by examiner

*Primary Examiner* — David H Bollinger
(74) *Attorney, Agent, or Firm* — Banner & Witcoff, Ltd.

(57) ABSTRACT

A separation unit includes a separation pad configured to separate sheets one by one by making the sheets contact with a nip portion of the separation pad, a holder configured to hold the separation pad, and a supporting member configured to keep a base end of the separation pad to the holder. The separation pad includes a supported portion receded in the base end of the separation pad. The supporting member includes an attaching portion configured to attach the supporting member to the holder and a holding portion configured to fit in the supported portion to hold the supported portion in cooperation with the holder.

12 Claims, 12 Drawing Sheets

SHEET FEEDING DEVICE AND SEPARATION UNIT

CROSS-REFERENCE TO RELATED APPLICATION

This application claims priority from Japanese Patent Application No. 2011-262887 filed on Nov. 30, 2011, which is incorporated herein by reference.

FIELD OF DISCLOSURE

The disclosure relates to a separation unit configured to separate sheets one by one and a sheet feeding device including the separation unit.

BACKGROUND

A known image scanner or printer includes a sheet feeding device configured to feed sheets. For example, an image scanner includes a tray on which sheets are stacked. The sheet feeding device may feed sheets stacked on the tray one by one.

A sheet feeding device may include a roller and a separation pad configured to contact a peripheral surface of the roller. The separation pad is held by a holder. A sheet is fed from a tray in accordance with the rotation of the roller. The sheet is fed toward a nip portion between the peripheral surface of the roller and the separation pad so that ideally just one sheet contacting the peripheral surface of the roller passes between the peripheral surface of the roller and the separation pad.

Further, the holder includes a protrusion that protrudes toward the roller. In correspondence with the protrusion, the separation pad includes a hole that fits over the protrusion. The protrusion of the holder is inserted into the hole of the separation pad. Base ends of the holder and the separation pad are held by a clip having a U-shape in cross section. Thus, the separation pad is supported by the holder.

If the hole is exposed on a surface of the separation pad that contacts with the roller, a leading end of the sheet being fed toward the nip portion between the peripheral surface of the roller and the separation pad, may be caught in the hole. This may cause breakage or damage to the sheet.

As a countermeasure, film may be disposed between the separation pad and the clip to cover the hole. However, when the film is implemented, the sheets may slip under the film, causing feeding of plural sheets at one time. Especially, with a structure in which the distance between the base end of the separation pad and the peripheral surface of the roller is relatively large, feeding of plural sheets at one time may be likely to occur, because the number of the sheets entering between the base end of the separation pad and the peripheral surface of the roller may be relatively large.

SUMMARY

Therefore, a need has arisen for a separation unit and a sheet feeding device including the separation unit which may overcome these and other shortcomings of the related art. A technical advantage of the disclosure may be that a separation unit and a sheet feeding device including the separation unit may reduce damages on sheets and feeding of plural sheets at one time.

According to one or more aspects of the disclosure, a sheet feeding device may comprise a tray comprising a sheet placing portion configured to receive a sheet, a roller configured to feed the sheet from the sheet placing portion in a feeding direction, and the separation unit configured to contact with a peripheral surface of the roller. The separation unit may comprise a separation pad, a holder, and a supporting member. The separation pad may be configured to separate sheets one by one by making the sheets contact with a nip portion of the separation pad. The separation pad may comprise a supported portion receded in a base end of the separation pad. The holder may be configured to hold the separation pad. The supporting member may be configured to keep the base end of the separation pad connected to the holder. The supporting member may comprise an attaching portion configured to attach the supporting member to the holder and a holding portion configured to fit in the supported portion to hold the supported portion in cooperation with the holder.

According to one or more aspects of the disclosure, a separation unit may comprise a separation pad configured to separate sheets one by one by making the sheets contact with a nip portion of the separation pad, a holder configured to hold the separation pad, and a supporting member configured to keep a base end of the separation pad connected to the holder. The separation pad may comprise a supported portion receded in a base end of the separation pad. The supporting member may comprise an attaching portion configured to attach the supporting member to the holder and a holding portion configured to fit in the supported portion to hold the supported portion in cooperation with the holder.

According to one or more aspects of the disclosure, a separation unit may comprise a separation means for separating sheets one by one by making the sheets contact with a nip portion of the separation means, a holder means for holding the separation means, and a supporting means for keeping the base end of the separation means connected to the holder means. The separation means may comprise a supported means receded in a base end of the separation means. The supporting means may comprise an attaching means for attaching the supporting means to the holder means and a holding means for fitting in the supported means to hold the supported means in cooperation with the holder means.

BRIEF DESCRIPTION OF THE DRAWINGS

For a more complete understanding of the present disclosure, needs satisfied thereby, and the objects, features, and advantages thereof, reference now is made to the following description taken in connection with the accompanying drawings.

DETAILED DESCRIPTION

Figure 1:
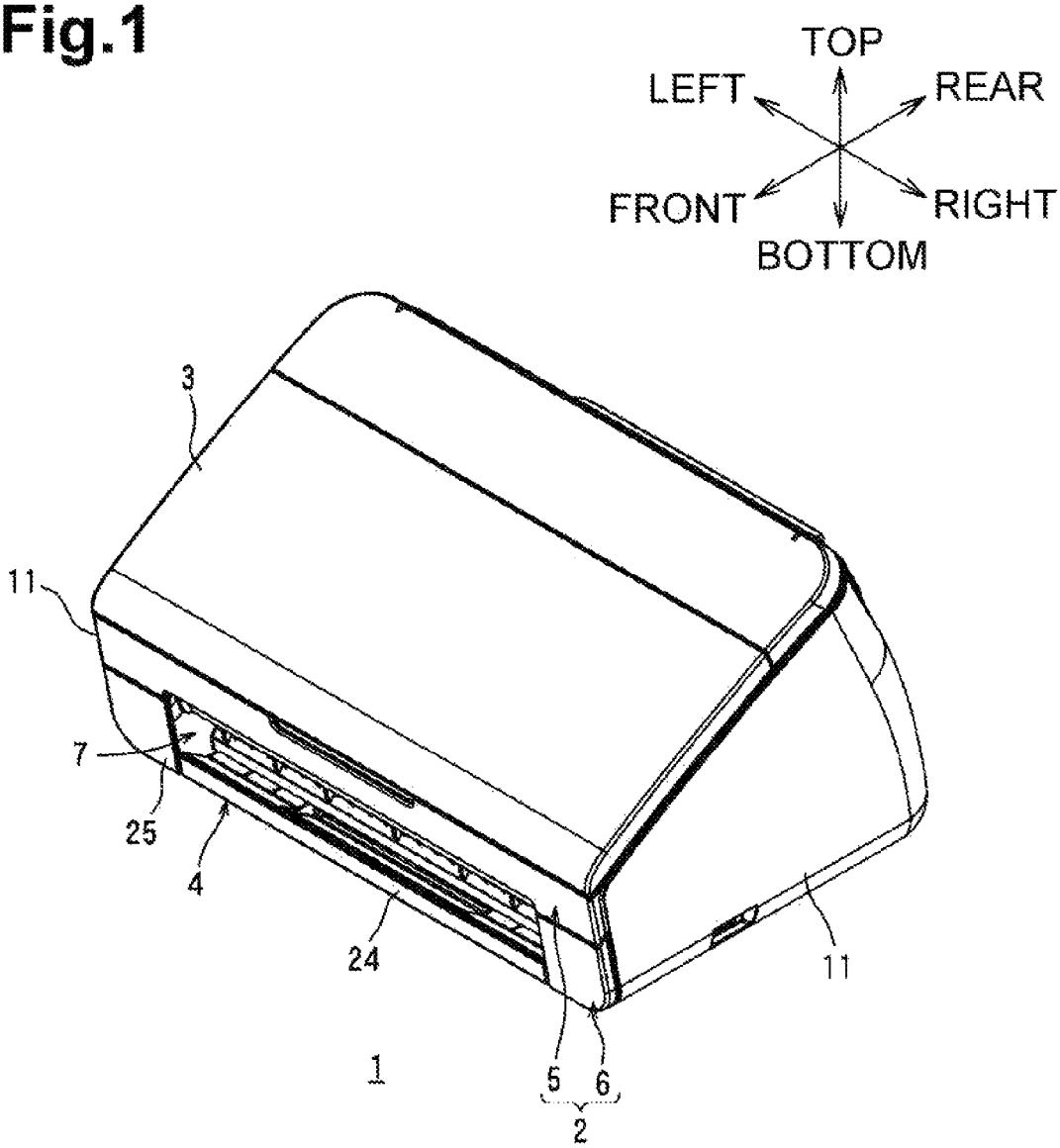
FIG. 1 is a perspective view of an image scanner in an example embodiment according to one or more aspects of the disclosure, wherein the image scanner is unused.

Example embodiments are described in detail herein with reference to the accompanying drawings, like reference numerals being used for like corresponding parts in the various drawings.

As depicted in FIG. 1, an image scanner 1 may comprise a scanner body 2, a sheet supply tray 3, and an output tray 4.

The scanner body 2 may comprise an upper unit 5 and a lower unit 6. A sheet output opening 7 may be formed on a front side of the scanner body 2 to straddle the upper unit 5 and the lower unit 6.

Front, rear, left, right, top, and bottom sides of the image scanner 1 may be defined in conjunction with an orientation in which the image scanner 1 placed on a plane surface is viewed from its front side. To facilitate understanding of orientation of the image scanner 1, its front, rear, left, right, top, and bottom sides may be determined with reference to axes of the three-dimensional Cartesian coordinate system included in each of the relevant figures.

Figure 2:
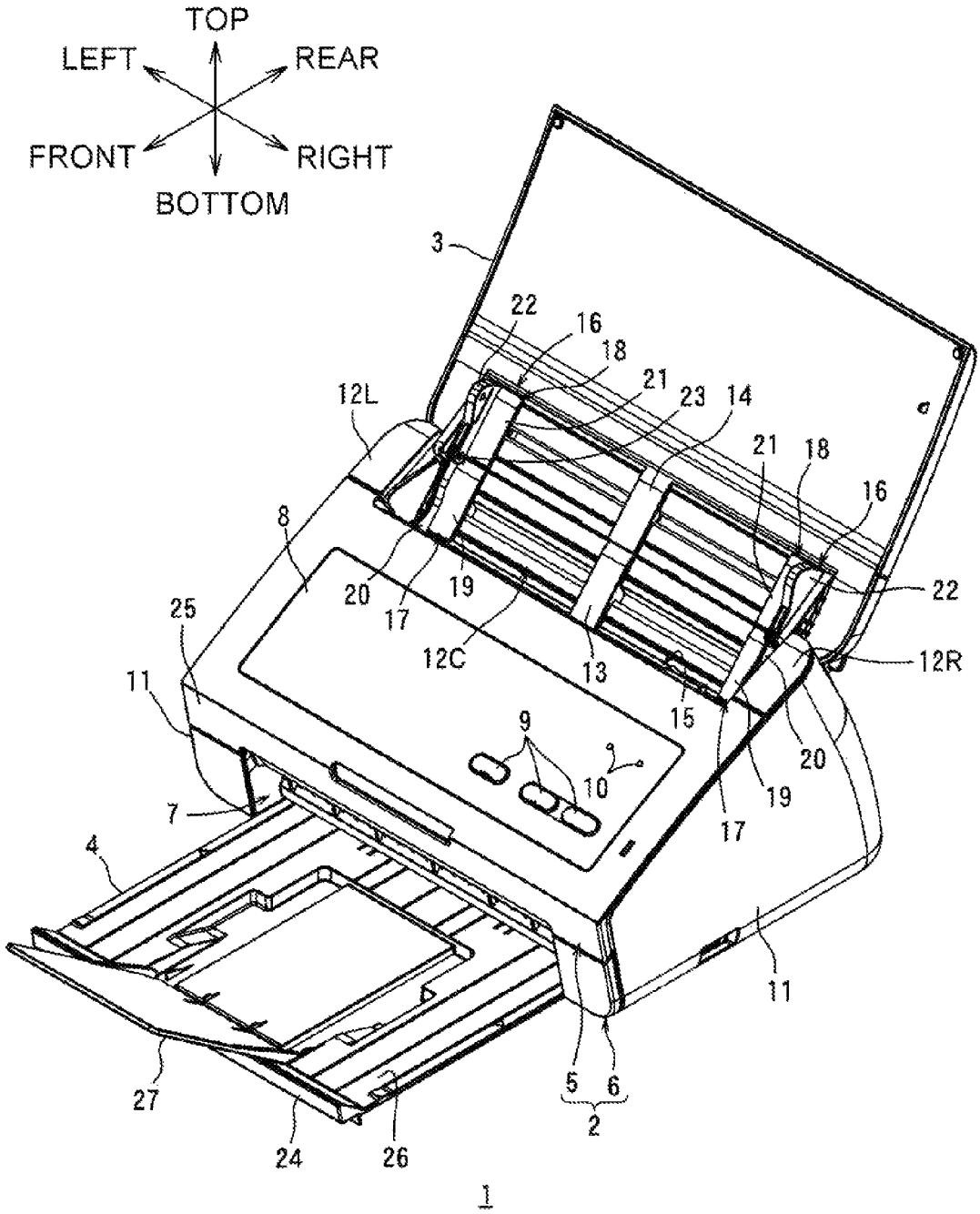
FIG. 2 is a perspective view of the image scanner, when the image scanner is used.

The upper unit 5 may be pivotally coupled to the lower unit 6 about an axis extending laterally, e.g., in a left-right direction of the scanner 1, along the front upper end of the lower unit 6. The upper unit 5 may pivotally move to a normal position, e.g., the position as depicted in FIG. 2, and a maintenance position (not depicted). In the normal position, the upper unit 5 may slant forwardly and downwardly. In the maintenance position, the rear end of the upper unit 5 placed in the normal position may be raised upwardly. In the maintenance position, a portion between the upper unit 5 and the lower unit 6 may be exposed, so that sheet jams may be cleared or maintenance of the scanner 1 may be performed.

As depicted in FIG. 2, a control panel 8 may be provided on an upper surface of the upper unit 5. The control panel 8 may comprise a plurality of buttons 9 and pilot lamps 10.

The lower unit 6 may comprise a side panel 11 on each right and left end thereof. The side panel 11 may have a trapezoidal shape when viewed from the side of the image scanner 1. The side panels 11 may define the right and left sides of the image scanner 1. When the upper unit 5 is in the normal position, the side panels 11 may sandwich the upper unit 5 in the lateral direction so as to cover right and left side surfaces of the upper unit 5. In the normal position, an upper surface of the upper unit 5 may be disposed approximately within the same plane as an upper edge of each side panel 11.

The lower unit 6 may comprise a central portion 12C positioned at a central portion of an upper rear end portion of the lower unit 6 in the lateral direction, a left end portion 12L positioned on the left side of the central portion 12C and a right end portion 12R positioned on the right side of the central portion 12C. An upper surface of the central portion 12C may slant forwardly and downwardly. The central portion 12C may assist in feeding the sheets from the sheet supply tray 3. The central portion 12C may support a body-side guide member 13 of approximately a rectangular shape, at a central portion of the central portion 12C in the lateral direction. The body-side guide member 13 may assist in guiding the sheets in the sheet feeding direction.

The left and right end portions 12L, 12R may protrude upward from the central portion 12C. The left and right end portions 12L, 12R may have substantially a rectangular parallelepiped shape. When the upper unit 5 is in the normal position, upper surfaces of the left and right end portions 12L, 12R may be approximately flush with the upper surface of the upper unit 5. A right side surface of the left end portion 12L and a left side surface of the right end portion 12R may each comprise a supporting shaft (not depicted) extending collinearly and inwardly in the lateral direction.

The supporting shafts may pivotally support the sheet supply tray 3. The sheet supply tray 3 may pivotally move to a folded position as depicted in FIG. 1 and an extended position as depicted in FIG. 2. In the folded position, the sheet supply tray 3 may lay against an upper (or top) surface of the scanner body 2. In the extended position, the sheet supply tray 3 may extend rearward and upwardly from an upper rear end of the scanner body 2 at approximately the same angle as an inclination angle of the central portion 12C. The sheet supply tray 3 may have a plate shape, which may be substantially the same shape and surface area as the upper (or top) surface of the scanner body 2. Therefore, the sheet supply tray 3 may cover the upper surface of the scanner body 2 when the sheet supply tray 3 is in the folded position.

An inner surface of the sheet supply tray 3, i.e., the surface facing upward (in the top direction) when the sheet supply tray 3 is in the extended position, may comprise a tray-side guide member 14 of a substantially rectangular shape. The tray-side guide member 14 may be supported by the inner surface of the sheet supply tray 3 so as to be disposed at a front end of the sheet supply tray 3 behind the body-side guide member 13 when the sheet supply tray 3 is in the extended position.

A sheet feed opening 15 may be disposed in front of the central portion 12C when the sheet supply tray 3 is in the extended position. The sheet feed opening 15 may extend in the lateral direction and may have an approximately rectangular shape.

A pair of sheet width guide members 16 may be disposed over the central portion 12C when the sheet supply tray 3 is in the extended position.

Each sheet width guide member 16 may comprise a body-side guide member 17 and a tray-side guide member 18.

The body-side guide member 17 may comprise a sheet placing portion 19 and a width regulating portion 20 that may be formed integrally. The sheet placing portion 19 may be disposed along the upper surface of the central portion 12C. The sheet placing portion 19 may have substantially a rectangular shape. The sheet placing portion 19 may have substantially the same shape as the body-side guide member 13. The width regulating portion 20 may stand perpendicular to the sheet placing portion 19 from an outer edge of the sheet placing portion 19 in the lateral direction and extends in the front-rear direction.

The meaning of "perpendicular" herein includes at an angle of 90 degrees, as well as at approximately 90 degrees including some tolerances, to a given line, plane, or surface.

The tray-side guide member 18 may comprise a sheet placing portion 21 and a width regulating portion 22 that may be formed integrally. The sheet placing portion 21 may be disposed along the upper surface of the central portion 12C. The sheet placing portion 21 may have substantially a rectangular shape. The sheet placing portion 21 may have substantially the same shape as the tray-side guide member 14. The width regulating portion 22 may stand perpendicular to the sheet placing portion 21 at an outer edge of the sheet placing portion 21 in the lateral direction and extends in the front-rear direction.

The width regulating portion 20 of the body-side guide member 17 may comprise a coupling shaft 23 extending laterally from a rear end of the width regulating portion 20. An axis of the coupling shaft 23 may correspond to an axis of the supporting shaft, which may allow the sheet supply tray 3 to pivot. The width regulating portion 22 of the tray-side guide member 18 may comprise an overlapping portion that may overlap laterally with the rear end of the width regulating portion 20. A tip of the coupling shaft 23 may be inserted into a hole formed in the overlapping portion. With such a structure, in accordance with the pivotal movement of the sheet supply tray 3, the tray-side guide members 18 may pivot on the coupling shafts 23. When the sheet supply tray 3 is in the extended position, the body-side guide member 17 and the tray-side guide member 18 may align in a front-rear direction of the scanner 1.

Each of the sheet width guide members 16 may be configured to move by the same amount with the center therebetween as a reference, so as to approach or separate from each other.

At a minimum distance between the sheet width guide members 16, i.e., when the sheet width guide members 16 move closest to each other, the distance between the left and right width regulating portions 20, 22 may generally correspond to a length of the shorter side of a sheet of a business card. A sheet of a business card may be placed over the guide members 13, 14, and the sheet placing portions 19, 21 of the sheet width guide members 16. In other embodiments, the minimum distance may be even less than the length of the shorter side of a sheet of a business card.

At a maximum distance between the sheet width guide members 16, i.e., when the sheet width guide members 16 move furthest from each other, the distance between the left and right width regulating portions 20, 22 may generally correspond to a length of the shorter side of a sheet of a legal size. A front end, i.e., a leading end, of a sheet of a legal size may be placed over the guide members 13, 14, and the sheet placing portions 19, 21 of the sheet width guide members 16. In other embodiments, the maximum distance may be even greater than the length of the shorter side of a legal size sheet.

As to sheet sizes bigger than a business card size and smaller than the legal size, a pair of the sheet width guide members 16 may be moved to make the distance between the width regulating portions 20, 22 correspond to the size of a sheet in its lateral direction. Thus, the sheet may be placed over the guide members 13, 14, and the sheet placing portions 19, 21 of the sheet width guide members 16.

Thus, sheets may be set over the upper rear end of the lower unit 6 of the scanner body 2 and the sheet supply tray 3, such that the center of the sheets in their lateral direction corresponds to the center of the distance between the guide members 16, i.e., the center of the sheet feed opening 15 in its lateral direction.

The output tray 4 may have an approximately rectangular plate shape. The output tray 4 may move to an accommodated position, as depicted in FIG. 1, in which the tray 4 is accommodated in a lowermost part of the lower unit 6, and a pulled position, as depicted in FIG. 2, in which the tray 4 is pulled in front of the scanner body 2 from the sheet output opening 7. In the accommodated position, a front face 24 of the output tray 4 may be flush with a front face 25 of the scanner body 2. In the pulled position, an upper surface 26 of the tray 4 may face upward as a sheet receiving surface, as depicted in FIG. 2.

An extension plate 27 may be pivotally provided on the upper surface 26 about an axis extending along a frond end of the output tray 4. The extension plate 27 may move to a folded position in which the extension plate 27 is folded down toward the upper surface 26 and an extended position, as shown in FIG. 2, in which the extension plate 27 is extended in an upward and forward direction from the front end of the upper surface 26 when the output tray 4 is pulled forwardly from the scanner body 2.

Figure 3:
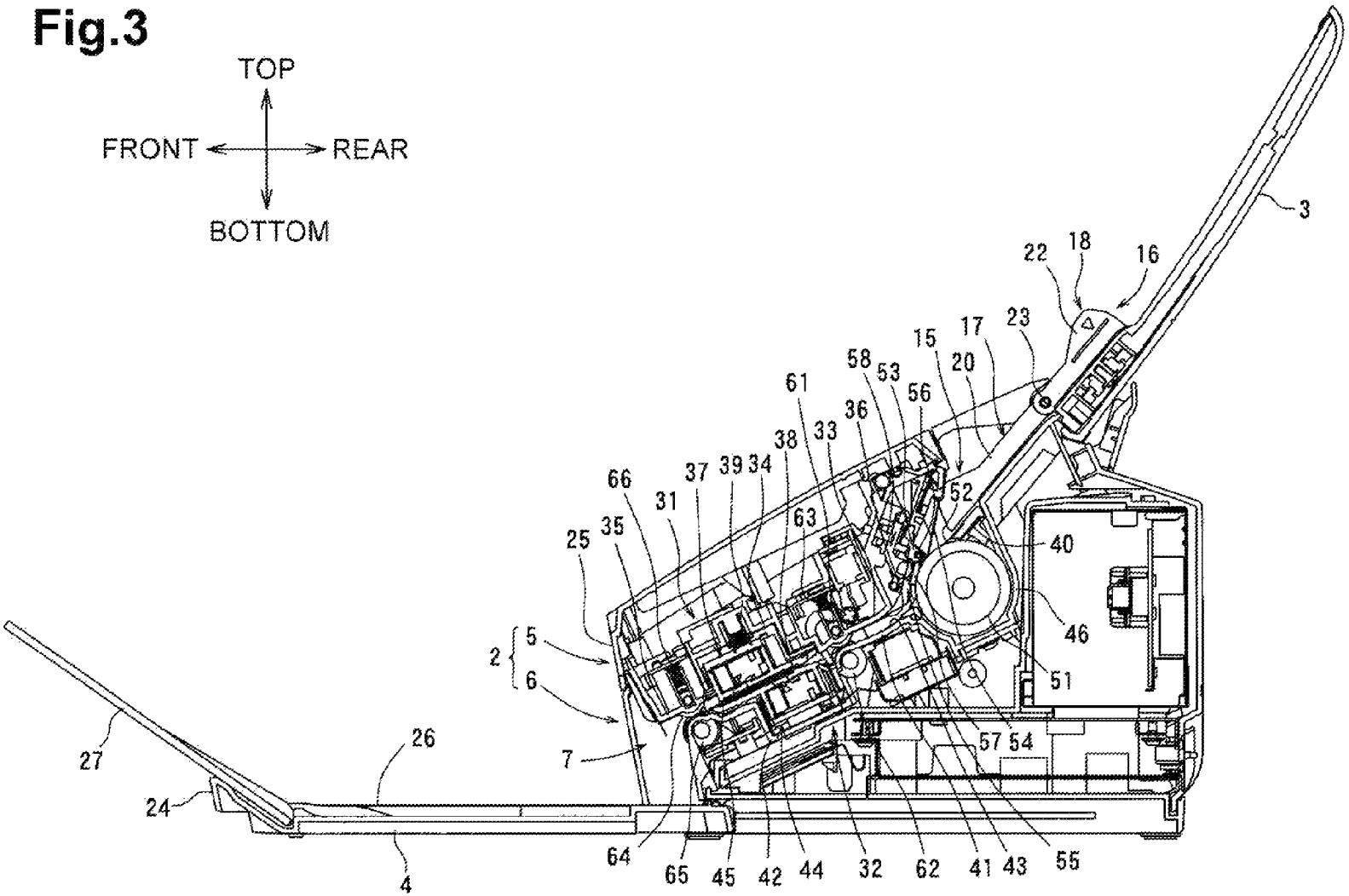
FIG. 3 is a side sectional view of the image scanner.

As depicted in FIG. 3, the upper unit 5 and the lower unit 6 may comprise an upper frame 31 and a lower frame 32, respectively. Rear edges of the upper frame 31 and the lower frame 32 may define the sheet feed opening 15.

The upper frame 31 may comprise a first upper guide 33, an upper CIS holder 34 and a final guiding portion 35 formed in this order from the rear side of the scanner 1.

A lower surface of the first upper guide 33 opposing the lower frame 32 may function as a guide surface 36 to guide a sheet. The guide surface 36 may comprise a sharp sloping rear end portion, a middle curve portion, and a gentle sloping front end portion. The sharp sloping portion at the rear end portion of the guide surface 36 may extend in a forward and downward direction at a relatively sharp inclination. The curve portion at the middle portion of the guide surface 36 may include a concave curve from a rear and top location to a front and lower location. The gentle sloping portion at the front end portion of the guide surface 36 may extend in a forward and downward direction at a relatively gentle inclination.

The upper CIS holder 34 may have an approximately rectangular recess receding in a frontward and upward direction. The upper CIS holder 34 may hold an upper CIS unit 37 therein. The upper CIS unit 37 may comprise a contact glass 38. The upper CIS unit 37 may hold the contact glass 38 such that the glass 38 may be opposed to the lower frame 32. A coil spring 39 may be disposed between a base end surface of the upper CIS holder 34 and the upper CIS unit 37. When a sheet being fed is thick, the upper CIS unit 37 may move according to the thickness of the sheet, so that the sheet may be fed while favorably making contact with the contact glass 38.

The final guiding portion 35 may extend in a frontward and downward direction approximately at the same inclination angle as the front end portion of the guide surface 36.

The lower frame 32 may comprise a guide 40, a first lower guide 41, and a lower CIS holder 42 formed in this order from the rear side of the scanner 1.

An upper surface of the guide 40 may be formed nearly into a flat surface that may incline in a frontward and downward direction approximately at the same inclination angle of each upper surface of the guide members 13, 14, and the sheet placing portions 19, 21 of the sheet width guide members 16 where the sheets may be placed.

An upper surface of the first lower guide 41 opposing the upper frame 31 may function as a guide surface 43 to guide a sheet. The guide surface 36 of the first upper guide 33 and the guide surface 43 may have a space therebetween. In correspondence with the curvature of the guide surface 36, the guide surface 43 may protrude in a rearward and downward direction and extend in a forward and downward direction parallel to the front end of the guide surface 36.

Herein, "parallel" lines, planes, etc. extend in the same direction and are equidistant at all or some points, e.g., a "parallel" line, plane, etc. may slightly slant or curve with respect to another or others.

The lower CIS holder 42 may have an approximately rectangular recess receding in a rearward and downward direction. The lower CIS holder 42 may hold a lower CIS unit 44 therein. The lower CIS holder 42 may comprise a contact glass 45. The lower CIS holder 42 may hold the contact glass 45 such that the glass 45 may be opposed to the upper frame 31.

The lower frame 32 may comprise a roller accommodating portion 46. The roller accommodating portion 46 may have a recess receding in a rearward and downward direction at each central portion of the guide 40 and the first lower guide 41 in their lateral direction.

The roller accommodating portion 46 may be configured to rotatably accommodate a roller, e.g., a pickup roller 51. A portion of a peripheral surface of the pickup roller 51 may protrude from upper surfaces of the guide 40 and the first lower guide 41 in a frontward and upward direction. The pickup roller 51 may rotate counterclockwise when viewed from the right side of the scanner 1, to feed a sheet.

A sheet-like guide 52 may be disposed on an upper surface of the guide 40 so as to extend from the upper surface of the guide 40 to a portion of a peripheral surface of the pickup roller 51 protruding from the upper surface of the guide 40. The sheet-like guide 52 may be disposed such that a center of the guide 52 in its lateral direction may correspond to a center of the pickup roller 51 in its lateral direction. The sheet-like guide 52 may comprise film. A base end of the sheet-like guide 52 may be supported on the upper surface of the guide 40 and a free end of the guide 52 may contact a portion of the peripheral surface of the pickup roller 51.

Figure 4:
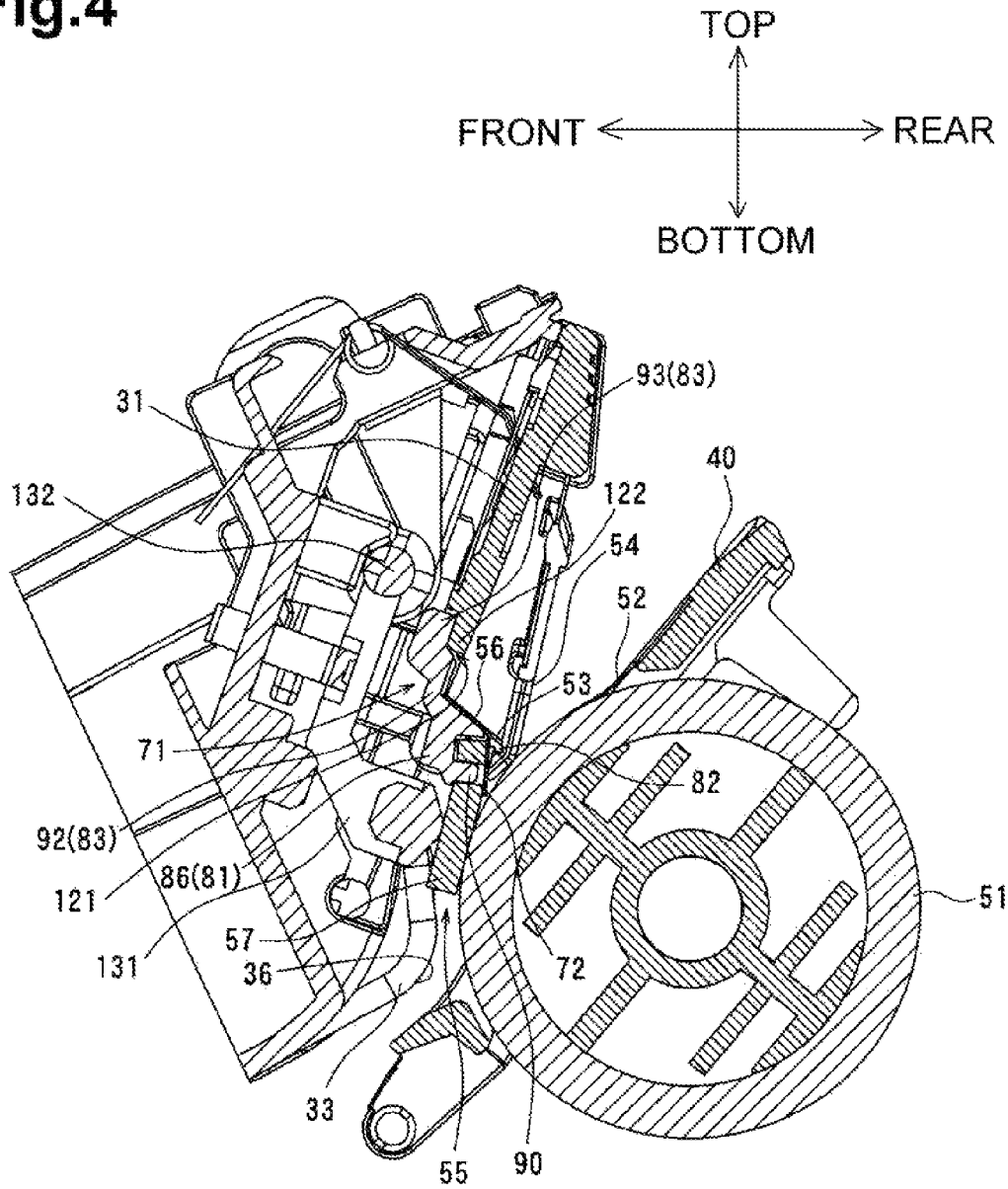
FIG. 4 is a side sectional view of a separation unit of the image scanner and a periphery of the separation unit.

As depicted in FIGS. 3 and 4, the upper frame 31 may comprise a regulating member 53, a sheet pressing member 54, and a separation unit 55 in front of and at an upper side of the pickup roller 51.

The regulating member 53 may be disposed downstream of the sheet-like guide 52 in a sheet feeding direction, which includes directions that the sheet moves through the image scanner 1. The regulating member 53, from a side view, appears to point toward the pickup roller 51. The regulating member 53 may comprise a regulating surface 56. In the sectional view depicted in FIG. 4, the regulating surface 56 may extend substantially collinearly with a radius of the pickup roller 51 perpendicular to a line extending along the upper surface of the guide 40.

The sheet pressing member 54 may comprise a plate spring. A base end of the sheet pressing member 54 may be attached to a rear end of the upper frame 31. A free end of the sheet pressing member 54 may contact a portion of the peripheral surface of the pickup roller 51 from above in front of the roller 51.

The separation unit 55 may comprise a separation pad 57. The separation pad 57 may comprise rubber. The separation pad 57 may be disposed downstream of the regulating member 53 in the rotational direction of the pickup roller 51. A surface of the separation pad 57 may elastically contact a portion of the peripheral surface of the pickup roller 51 by an urging force of a spring (not depicted). The separation pad 57 is configured to separate sheets one by one by making the sheets contact with one surface of the separation pad 57 on one side.

As depicted in FIG. 3, line feed (LF) rollers 61, 62 may be rotatably disposed at front ends of the first upper guide 33 and the first lower guide 41, respectively, on axes extending laterally. A portion of the peripheral surface of the LF roller 61 may protrude in a rearward and downward direction from a lower surface, i.e., the guide surface 36, of a front end of the first upper guide 33. A portion of the peripheral surface of the LF roller 62 may protrude in a frontward and upward direction from an upper surface, i.e., the guide surface 43, of a front end of the first lower guide 41. The peripheral surface of the LF roller 61 may elastically contact the peripheral surface of the LF roller 62 from above in front of the LF roller 62 as a result of a downward force applied by a spring 63.

Output rollers 64, 65 may be rotatably disposed at the final guiding portion 35 of the upper frame 31 and a front end of the lower frame 32, respectively, on axes extending laterally. A portion of the peripheral surface of the output roller 64 may protrude in a rearward and downward direction from a lower surface of the final guiding portion 35. A portion of the peripheral surface of the output roller 65 may protrude in a frontward and upward direction from an upper surface of a front end of the lower frame 32.

The image scanner 1 may be configured to selectively read an image formed on upper and lower surfaces, e.g., front and back sides, of a sheet. The scanner 1 may be configured to read an image on each side of the sheet simultaneously.

Distance between the guide members 16 may be adjusted to the size, e.g., a width, of a sheet to be read. A sheet to be read may be inserted between the guide members 16 from above and the rear side of the scanner 1. The sheet may be placed over the guide members 13, 14, and the sheet placing portions 19, 21 of the sheet width guide members 16. At this time, a leading end of the sheet may slide over the guide members 13, 14, and the sheet placing portions 19, 21. The leading end of the sheet may move to the guide 40 of the lower frame 32 though the sheet feed opening 15. The leading end of the sheet may further slide over the guide 40 toward the pickup roller 51.

When a stack of sheets is set in the scanner 1, a leading end of the lowermost sheet in its lateral direction may move from the guide 40 to the sheet-like guide 52. The central portion of the leading end of the sheet may slide over the sheet-like guide 52 and be guided on the peripheral surface of the pickup roller 51. As the leading end of the lowermost sheet contacts the separation unit 55, the sheet may stop due to the frictional resistance with the separation unit 55. Leading ends of an upper side of the stack of the sheets may stop by contacting the regulating surface 56 of the regulating member 53. Thus, a plurality of sheets may be set in the scanner 1 even though sheets are scanned one at a time.

The free end of the sheet pressing member 54 may be raised by the sheets inserted between the peripheral surface of the pickup roller 51 and the sheet pressing member 54. The sheet pressing member 54 may contact the upper surface of the uppermost sheet. The lowermost sheet may be pressed against the peripheral surface of the pickup roller 51 as a result of a downward force applied by the sheet pressing member 54.

As the pickup roller 51 rotates counterclockwise when viewed from the right, the lowermost sheet may be moved along with the peripheral surface of the pickup roller 51 by the frictional force between the lowermost sheet and the peripheral surface of the pickup roller 51. Sheets above the lowermost sheet may move following the lowermost sheet due to the frictional force applied between the lowermost sheet and the sheet directly above the lowermost sheet. However, the separation pad 57 may prevent sheets other than the lowermost sheet from passing a nip portion between the separation pad 57 and the peripheral surface of the pickup roller 51. Specifically, the separation pad 57 may regulate movement of the rest of the sheets when the leading ends of the sheets contact the surface of the separation pad 57. In other words, the separation pad 57 may block the leading ends of sheets other than the lowermost sheet from proceeding forward.

The sheet passing the nip portion between the separation pad 57 and the peripheral surface of the pickup roller 51 may be fed along a sheet feed path defined by the guide surface 36 of the first upper guide 33 and the guide surface 43 of the first lower guide 41. That is, the guide surfaces 36, 43 may guide the sheet through the sheet feed path.

When the leading end of the sheet contacts a nip portion between the LF rollers 61, 62, the leading end may be pulled into the nip portion due to the rotation of the LF rollers 61, 62.

The peripheral surfaces of the LF rollers 61, 62 may contact an upper surface and a lower surface of the sheet, respectively and feeding force may be applied to the sheet by the peripheral surfaces of the LF rollers 61, 62. Thus, the sheet may be continuously fed in the sheet feeding direction.

As the sheet is fed in the sheet feeding direction, the upper and lower surfaces of the sheet may face the contact glass 38 of the upper CIS unit 37 and the contact glass 45 of the lower CIS unit 44, respectively. Light may be emitted to the upper and lower surfaces of the sheet through light emitting portions of the contact glasses 38, 45. The upper and lower surfaces of the sheet may reflect the light. The light reflected off the upper and lower surfaces of the sheet may be received by image sensors contained in the upper CIS unit 37 and the lower CIS unit 44, respectively. Thus, images on the upper and lower surfaces of the sheet may be read.

When the leading end of the sheet contacts a nip portion between the output rollers 64, 65, the leading end may be pulled into the nip portion due to the rotation of the output rollers 64, 65. The peripheral surfaces of the output rollers 64, 65 may contact the upper and lower surfaces of the sheet, respectively and feeding force may be applied to the sheet by the peripheral surfaces of the output rollers 64, 65. Thus, the sheet may be continuously fed in the sheet feeding direction. When a trailing end of the sheet moves away from the output rollers 64, 65, the sheet may be output onto the upper surface 26 of the output tray 4.

Figure 5:
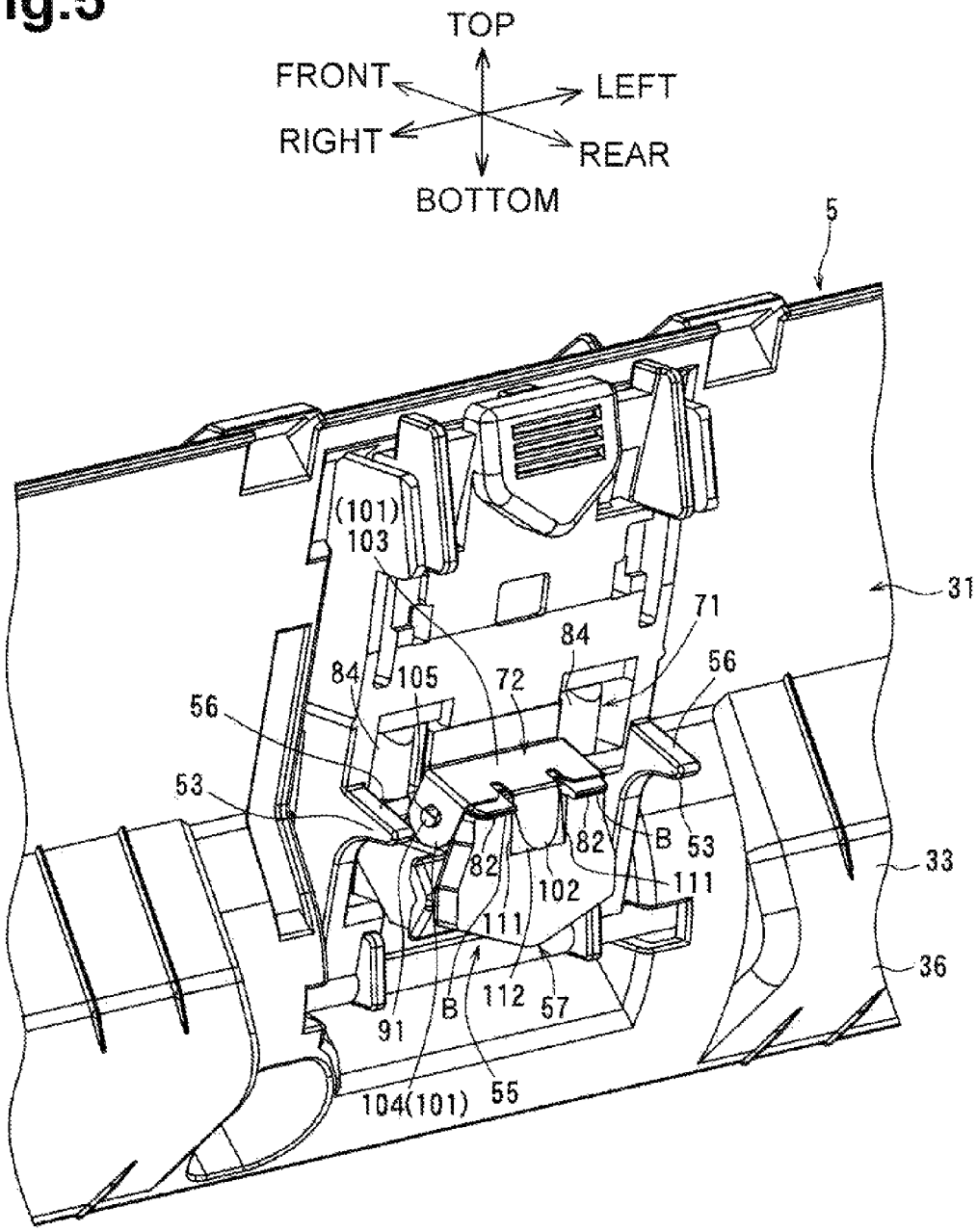
FIG. 5 is a perspective view of the separation unit and its periphery in an upper unit of the image scanner.
Figure 6:
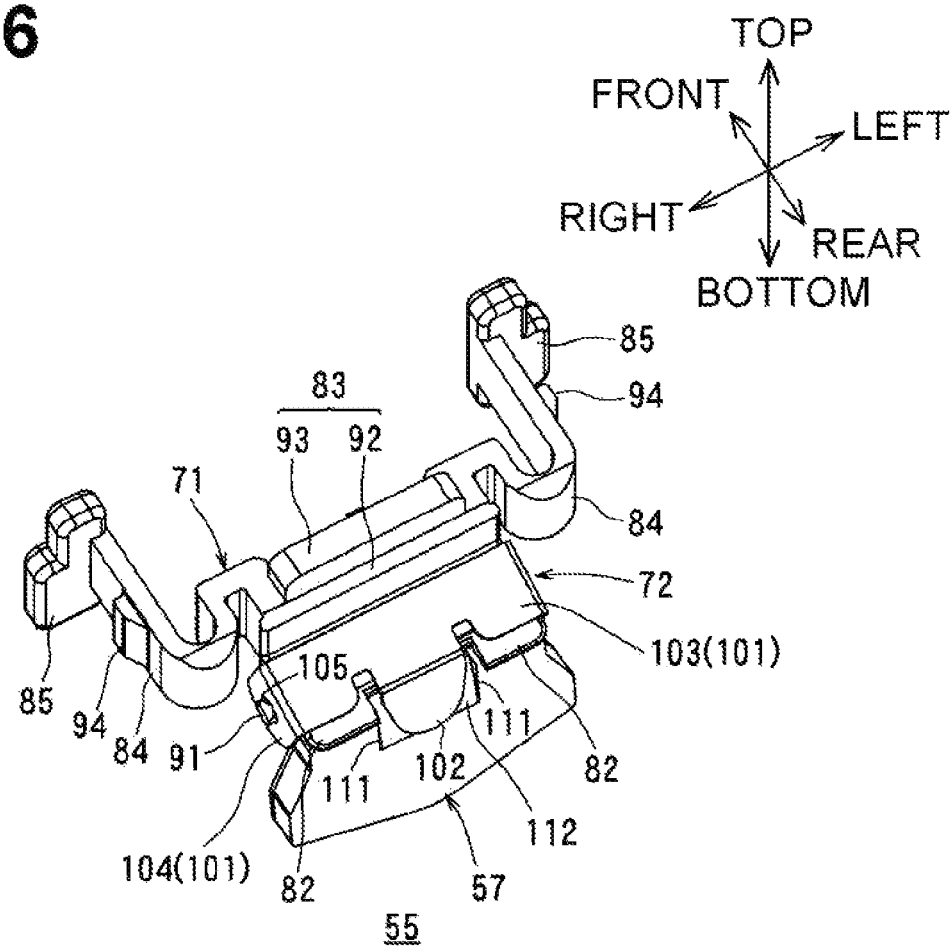
FIG. 6 is a perspective view of the separation unit.

As depicted in FIGS. 5 and 6, the separation unit 55 may further comprise a holder 71 configured to hold the separation pad 57 and a supporting member 72 configured to keep a base end of the separation pad 57 connected to the holder 71. The left, right, rear, front, top, and bottom sides of the separation unit 55 when the separation unit 55 is attached to the upper unit 5, may be hereinafter referred to as the left, right, rear, front, top, and bottom sides, respectively, as depicted in FIGS. 6-12.

Figure 7:
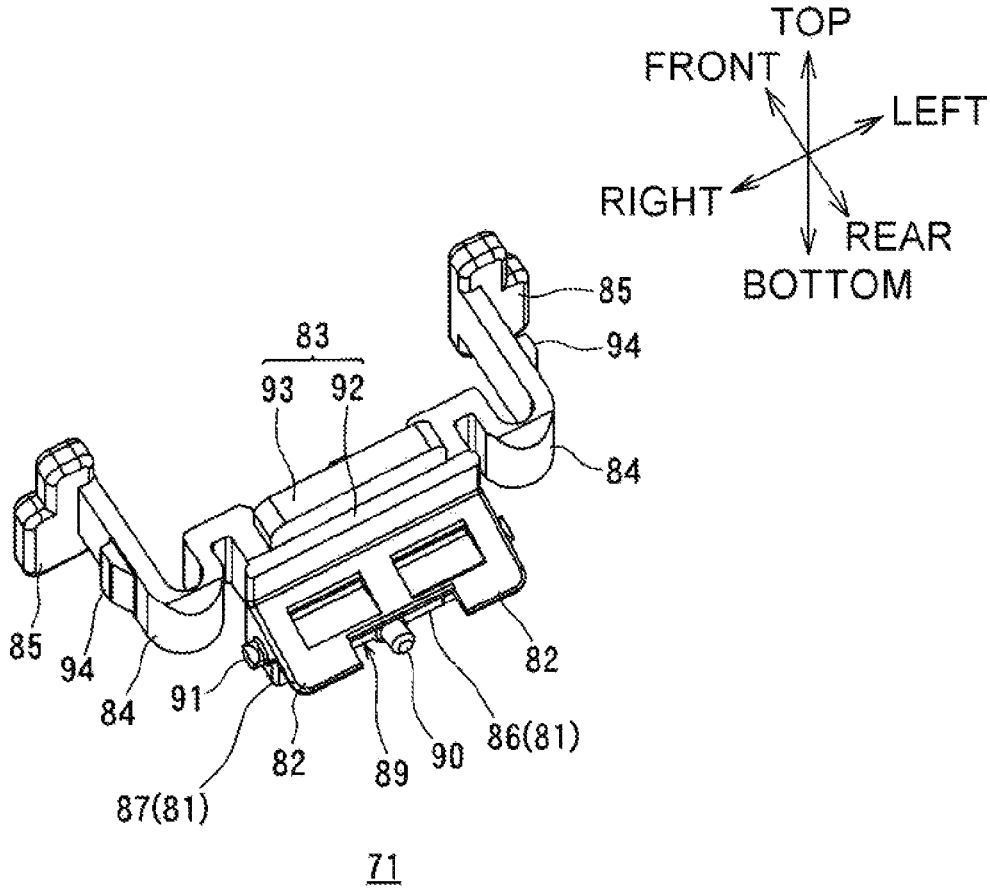
FIG. 7 is a top perspective view of a holder of the separation unit.
Figure 8:
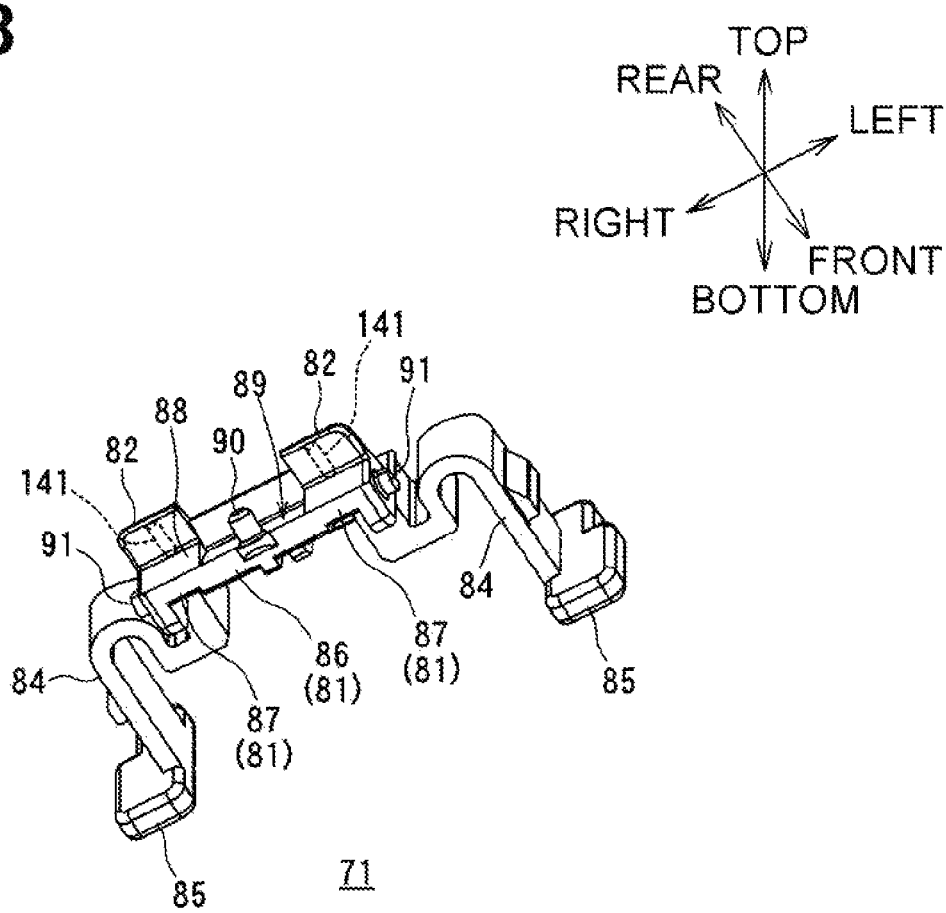
FIG. 8 is a bottom perspective view of the holder.

The holder 71 may be integrally formed of resin in one piece. As depicted in FIGS. 7 and 8, the holder 71 may comprise a body 81, a protrusion 82, a contact portion 83, an elastically deforming portion 84, and a grip portion 85.

As depicted in FIG. 8, the body 81 may comprise a central portion 86 and a side portion 87 disposed on each left and right side, of the central portion 86. Each side portion 87 may comprise each side surface perpendicular to the lateral direction. The central portion 86 may have substantially a rectangular shape extending laterally. Each side portion 87 may extend laterally from each left and right end of the central portion 86 and may bend toward the front side.

A holder surface 88 may be disposed on surfaces of the central portion 86 and the side portions 87 on the rear side. The holder surface 88 may be configured to oppose a surface of the separation pad 57. The surface of the separation pad 57 that may be configured to oppose the holder surface 88 may be opposite to a surface of the pad 57 configured to contact the peripheral surface of the pickup roller 51. The holder surface 88 may have a slope portion between the central portion 86 and each of the side portions 87. The holder surface 88 may comprise a recess 89 between the side portions 87.

The body 81 may comprise a knob 90 that may protrude from the recess 89 toward the rear side. The knob 90 may prevent the separation pad 57 from coming off from the holder 71 when the separation pad 57 is attached to the holder 71.

Each side portion 87 may comprise an attaching knob 91 that may protrude laterally and outwardly from an outer surface of each side portion 87. Each attaching knob 91 may protrude outward in the lateral direction from each of the side surfaces of the side portions 87.

The protrusions 82 may protrude toward the rear side from an end of each side portion 87 on the top side. A tip of each protrusion 82 may be curved.

As depicted in FIG. 7, the contact portion 83 may comprise a thinner portion 92 and a thicker portion 93.

The thinner portion 92 may be connected to an end of the body 81 on the top side. The thinner portion 92 may extend toward the front side and top side. The thinner portion 92 may have a rectangular shape. The thinner portion 92 may have the same length as the body 81 in the lateral direction.

The thicker portion 93 may extend from a surface of the thinner portion 92 on the front side toward the front side and the top side. The thicker portion 93 may have a length shorter than the thinner portion 92 in the lateral direction.

As depicted in FIGS. 7 and 8, the elastically deforming portion 84 may be disposed on each end of the holder 71 in the lateral direction. The left and right elastically deforming portions 84 may be bilaterally symmetric. Each elastically deforming portion 84 may extend from an end of the thinner portion 92 in the lateral direction toward the front side, bend outwardly in the lateral direction, make a U-turn toward the rear side, and then extend toward the front side.

The grip portion 85 may have a plate shape extending outwardly in the lateral direction from an end of each elastically deforming portion 84 on the front side.

Each elastically deforming portion 84 may comprise an engaging projection 94 that may protrude outwardly in the lateral direction. The engaging projection 94 may oppose the grip portion 85 and may project from the elastically deforming portion 84 at a distance from the grip portion 85 toward the rear side.

Figure 9:
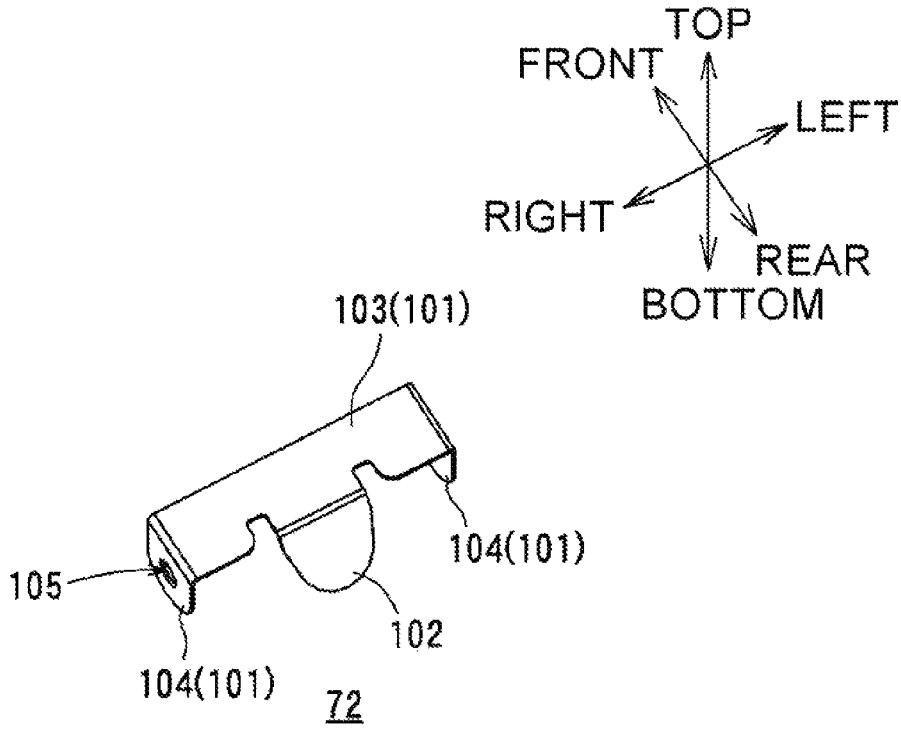
FIG. 9 is a top perspective view of a supporting member of the separation unit.
Figure 10:
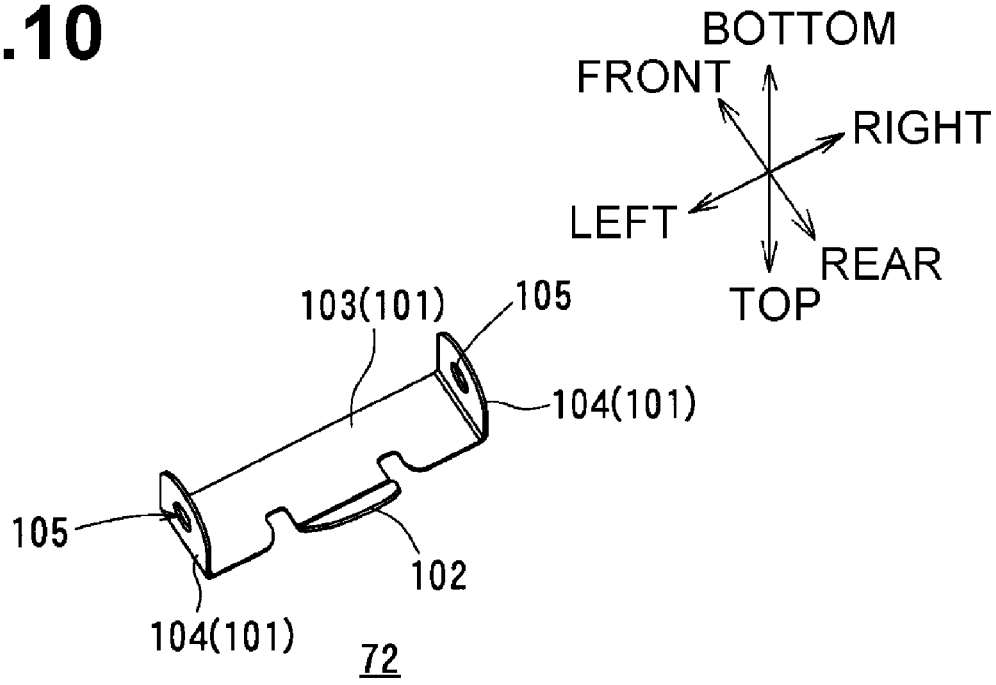
FIG. 10 is a bottom perspective view of the supporting member.

The supporting member 72 may be formed of, e.g., one or more metal thin plates. As depicted in FIGS. 6, 9, and 10, the supporting member 72 may comprise an attaching portion 101 and a holding portion 102. The attaching portion 101 may be configured to be attached to the holder 71. The attaching portion 101 and the holding portion 102 may be integrally formed in one piece.

The attaching portion 101 may comprise a base end opposing portion 103 and a pair of side opposing portions 104. The side opposing portions 104 may be configured to oppose the respective side portions 87 from outside in the lateral direction. The base end opposing portion 103 may be configured to oppose the surface of the base end of the separation pad 57. The protrusion 82 may be interposed between the separation pad 57 and the base end opposing portion 103.

The base end opposing portion 103 may have substantially a rectangular shape having substantially the same length as the body 81 of the holder 71.

The side opposing portion 104 may extend from each left and right end of the base end opposing portion 103 in one direction perpendicular to the base end opposing portion 103. Each side opposing portion 104 may have a relatively semicircular shape. Each side opposing portion 104 may have an attaching hole 105 formed therethrough into a circular shape. An inner diameter of the attaching hole 105 may be approximately equal to an outer diameter of the attaching knob 91 of the holder 71.

The holding portion 102 may slantingly extend from an end of a central portion of the base end opposing portion 103 in a direction, which may be the same direction that the side opposing portion 104 may extend. The holding portion 102 may also extend from an end of a central portion of the base end opposing portion 103 in a direction along the lateral, i.e., longitudinal, direction of the base end opposing portion 103. The holding portion 102 may have a relatively semicircular shape.

Figure 11:
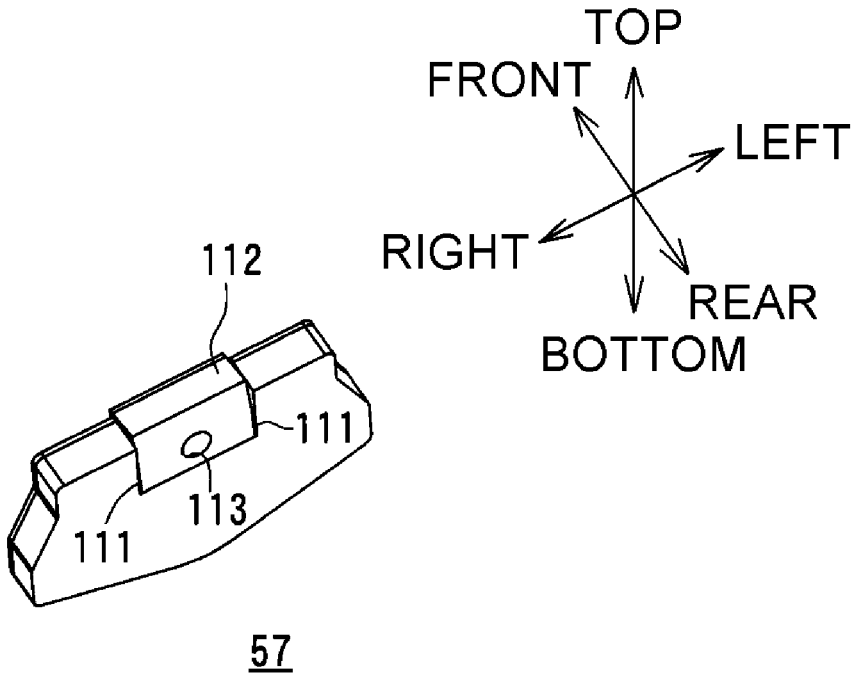
FIG. 11 is a perspective view of a separation pad of the separation unit.

As depicted in FIGS. 6 and 11, the base end of the separation pad 57 may have a rectangular shape extending laterally when viewed from the rear side. A middle portion of the separation pad 57 may be wider in the lateral direction than the base end and a tip portion of the separation pad 57. The tip portion of the separation pad 57 may have a triangular shape becoming narrower toward the tip.

A central portion of the base end of the separation pad 57 in the lateral direction may have two slits 111 with some distance therebetween in the lateral direction. The slits 111 may extend from the base end of the separation pad 57 toward the bottom side. The separation pad 57 may comprise a supported portion, e.g., a receded portion 112. The receded portion 112 may be disposed between the slits 111. The receded portion 112 may be separable from the right and left portions of the separation pad 57 so that the receded portion 112 may flex toward the rear and front sides. Thus, the receded portion 112 may be receded in a central portion of the base end in a lateral direction of the separation pad 57 toward the front side opposite to the rear side.

The receded portion 112 may have a hole 113 formed therethrough. An inner diameter of the hole 113 may be approximately equal to an outer diameter of the knob 90 of the holder 71. The hole 113 may prevent the separation pad 57 from coming off from the holder 71 as the hole 113 is inserted over the knob 90.

Before the separation unit 55 depicted in FIG. 6 is attached to the upper frame 31 depicted in FIG. 5, the separation unit 55 may be assembled from the separation pad 57, the holder 71 and the supporting member 72.

Figure 12:
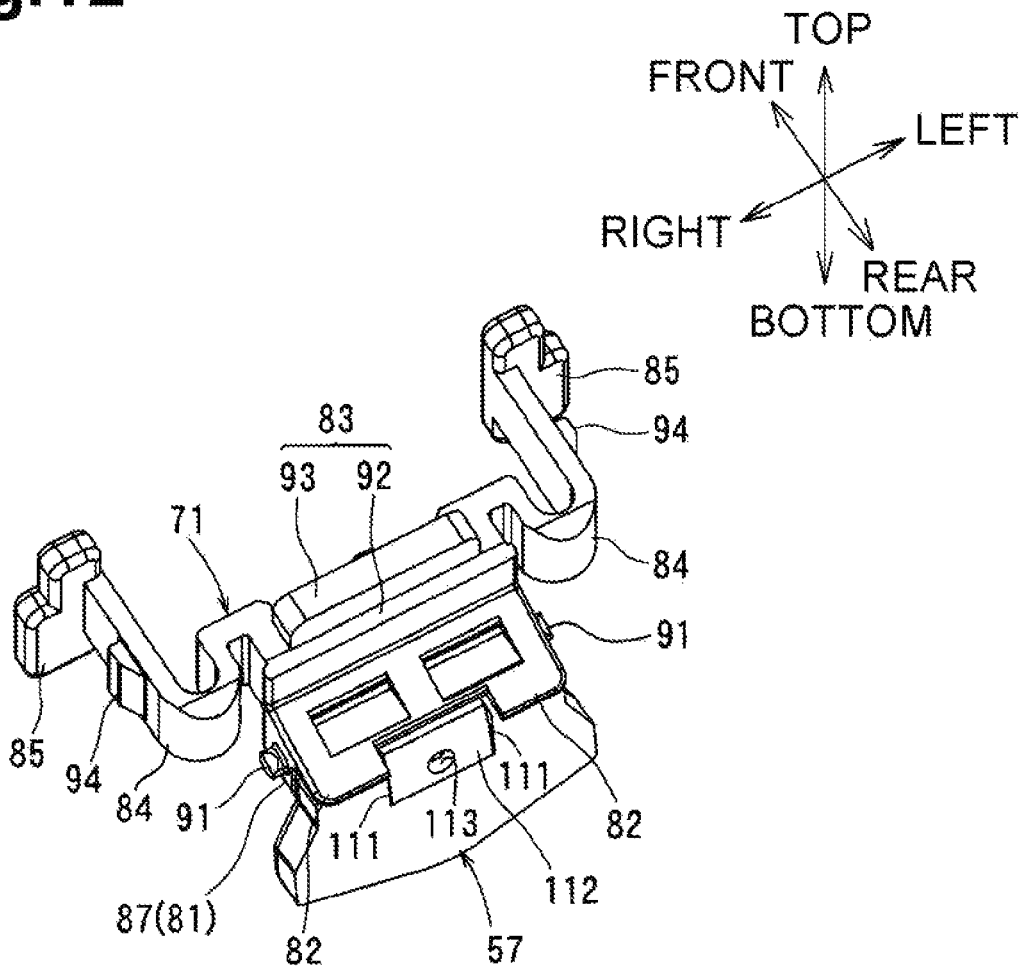
FIG. 12 is a perspective view of the separation pad and the holder.

To assemble the separation unit 55, a surface of the front side of the separation pad 57 may be directed toward the holder surface 88 of the body 81 of the holder 71 depicted in FIG. 8. The base end of the separation pad 57 may be brought closer to the body 81. As depicted in FIG. 12, the hole 113 of the separation pad 57 may be inserted over the knob 90 of the holder 71. Then, the separation pad 57 may be pressed toward the body 81. The surface of the front side of the separation pad 57 may be pressed against the holder surface 88. As the receded portion 112 of the separation pad 57 is pressed, the receded portion 112 may elastically deform to fit in the recess 89 of the holder surface 88. Thus, the receded portion 112 may recede from its left and right portions of the separation pad 57.

The supporting member 72 depicted in FIGS. 9 and 10 may be brought closer to the holder 71 such that the base end opposing portion 103 of the supporting member 72 may be opposed to a surface of the top side of the protrusion 82 of the holder 71 depicted in FIG. 7. While the side opposing portions 104 of the supporting member 72 are being deformed to slightly expand the distance therebetween, the body 81 of the holder 71 may be inserted between the side opposing portions 104. As the attaching holes 105 of the side opposing portions 104 oppose the relevant attaching knobs 91 of the holder 71 in the lateral direction, each side opposing portion 104 may return to its original position due to its elasticity. Thus, the attaching knobs 91 may be inserted into the relevant attaching holes 105. The holding portion 102 of the supporting member 72 may fit in the receded portion 112 of the separation pad 57. The receded portion 112 may be supported by the holding portion 102 and the central portion 86 of the body 81 of the holder 71. Thus, the holding portion 102 may be configured to fit in the receded portion 112 to hold the receded portion 112 in cooperation with the holder 71.

Thus, assembly of the separation unit 55 may complete.

With the assembly of the separation unit 55 completed, the protrusion 82 may protrude from a surface of the separation pad 57, as depicted in FIG. 6. As depicted in FIG. 5, a boundary B between the separation pad 57 and the protrusion 82 may be exposed on the side of the surface of the separation pad 57. In some embodiments, this boundary B may be unoccupied so that no other component comes between the separation pad 57 and the protrusion 82.

After the assembly of the separation unit 55 is completed, the separation unit 55 may be attached to the upper frame 31.

To attach the separation unit 55 to the upper frame 31 with the upper unit 5 open, the separation unit 55 may be inserted into an opening 121 formed in the upper frame 31 from a side of the upper frame 31 opposite to the pickup roller 51. As the thicker portion 93 of the holder 71 of the separation unit 55 contacts a portion 122 of the upper frame 31 above the opening 121, the separation unit 55 may become attached to the upper frame 31.

During the attaching of the separation unit 55 to the upper frame 31, the engaging projections 94 of the holder 71 may contact predetermined portions (not depicted) of the upper frame 31. Thereafter, as the separation unit 55 is moved, each engaging projection 94 may be pressed by the respective predetermined portion of the upper frame 31 so as to elastically deform the elastically deforming portions 84 of the holder 71 in a direction to approach each other. Each engaging projection 94 may climb over the respective predetermined portion of the upper frame 31 substantially at the same time as the thicker portion 93 contacts the portion 122 of the upper frame 31. Each elastically deforming portion 84 may return to its original position and each predetermined portion of the upper frame 31 may be interposed between the respective engaging projection 94 and the grip portion 85. Thus, the separation unit 55 may be held by the upper frame 31.

As the separation unit 55 is attached to the upper frame 31 and the upper unit 5 is closed, an end of a pressing arm 131 disposed in the upper frame 31 may contact a surface of the separation pad 57 from a side opposite to the pickup roller 51, as depicted in FIG. 4. The other end of the pressing arm 131 may be pivotally supported on a pivot shaft 132 that may extend laterally. The pressing arm 131 may slightly extend in a direction perpendicular to the surface of the separation pad 57 between the one end and other end of the arm 131. Then, the pressing arm 131 may extend in a frontward and upward direction and then in a rearward and upward direction. The spring (not depicted), which may be configured to make a surface of the separation pad 57 elastically contact the peripheral surface of the pickup roller 51, may be connected to a portion of the pressing arm 131 that may extend in the rearward and upward direction, to apply a force to the pressing arm 131 in a rearward and downward direction.

In the separation unit 55 attached to the upper frame 31, as depicted in FIGS. 4 and 5, the base end opposing portion 103 of the supporting member 72 may be positioned slightly downstream of the regulating surface 56 of the regulating member 53 in the sheet feeding direction.

Given the structure described herein, leading ends of sheets may contact the regulating surface 56, so that contact of the leading ends of the sheets to the base end opposing portion 103 may be reduced. Thus, pressing of the base end opposing portion 103 by leading ends of sheets may be reduced. Consequently, a shift in the position of the separation pad 57 may be reduced and favorable sheet separation performances of the separation pad 57 may be maintained.

As described above, the receded portion 112 may be formed on the base end of the separation pad 57 at the central portion thereof in the lateral direction. The supporting member 72 may comprise the attaching portion 101 and the holding portion 102. The attaching portion 101 of the supporting member 72 may be attached on the holder 71. The receded portion 112 may be held between the holding portion 102 of the supporting member 72 and the holder 71.

The receded portion 112 of the separation pad 57 may recede from each left and right side thereof toward the front side, i.e., opposite to a side of the separation pad 57 that contacts the sheet.

Given the structure described herein, when a sheet enters from the side of the base end of the separation pad 57, a leading end of the sheet might not be caught in the receded portion 112, so that damage to the sheet due to being caught in the receded portion 112 may be reduced.

The holding portion 102 of the supporting member 72 may fit in the receded portion that may be receded.

Given the structure described herein, when a sheet enters from the side of the base end of the separation pad 57, a leading end of the sheet might not be caught in the holding portion 102. This may reduce damage to the sheet.

Therefore, a film to cover the receded portion 112 might not have to be provided between the separation pad 57 and the supporting member 72. Accordingly, sheet damages and feeding of plural sheets at a time may be reduced. Furthermore, the hole 113 and the knob 90 are covered by the holding portion 102. Accordingly, a leading end of the sheet might not be caught in the hole 113 and the knob 90. Therefore, sheet damages may be reduced.

The separation pad 57 may have the two slits 111 extending from the base end of the separation pad 57 to interpose the receded portion 112 therebetween.

The receded portion 112 may be separable from each side thereof in the lateral direction by the two slits 111. Therefore, the receded portion 112 may be readily receded.

The holder 71 may comprise the holder surface 88 configured to be opposed to the rear surface of the separation pad 57. The holder surface 88 may have the recess 89 in which the receded portion 112 may fit.

As the receded portion 112 is receded, a portion of the surface of the front side of the separation pad 57 may stick out. The portion of the separation pad 57 may be fitted in the recess 89 of the holder surface 88. Accordingly, lifting of the separation pad 57 from the holder surface 88 may be reduced. Consequently, the separation pad 57 may be stably held by the holder 71 and the supporting member 72.

The receded portion 112 may have the hole 113 formed therethrough. The holder 71 may comprise the knob 90 that may be inserted into the hole 113.

As the knob 90 is inserted into the hole 113, the separation pad 57 might not come off from the holder 71.

To attach the attaching portion 101 of the supporting member 72 to the holder 71, the holder 71 may comprise the side portion 87 configured to be opposed to left and right end portions of the separation pad 57 and the attaching knob 91 that may protrude outward in the lateral direction from each side portion 87. The attaching portion 101 of the supporting member 72 may comprise the side opposing portions 104 configured to be opposed to the respective side portions 87 from outside in the lateral direction. Each side opposing portion 104 may have the attaching hole 105 configured to be inserted over the attaching knob 91.

The attaching portion 101 may be attached to the holder 71 by inserting each attaching knob 91 into the relevant attaching hole 105.

The attaching portion 101 may comprise the base end opposing portion 103. The holder 71 may comprise the protrusions 82 that may be disposed between the separation pad 57 and the base end opposing portion 103. Each protrusion 82 may protrude toward one surface of the separation pad 57.

The protrusions 82 may protrude like eaves for the base end of the separation pad 57. The base end of the separation pad 57 may be hidden by the protrusions 82 when viewed from the sheet feeding direction. Therefore, when a sheet enters from a side of the base end of the separation pad 57, a leading end of a sheet might not be caught in the base end of the separation pad 57. Consequently, the damages on a sheet may further be reduced.

As depicted in FIG. 5, the boundary B between the separation pad 57 and the protrusion 82 may be exposed on the front side of the separation pad 57 because other components might not be disposed on the boundary B. In other words, there might not be any other components between the separation pad 57 and the protrusion 82 at the boundary B.

Given the structure described herein, a component that may first contact a leading end of a sheet passing through a position facing the protrusions 82 may be the separation pad 57, i.e., a component configured to perform sheet separation. Consequently, the unfavorable sheet slide may be reduced and the feeding of plural sheets at one time may be reduced.

The holding portion 102 of the supporting member 72 may have a curved shape curving convexly toward the tip of the separation pad 57.

Given the structure described herein, when the separation unit 55 is assembled, the holding portion 102 may be safely handled.

The scanner 1 may comprise the regulating member 53 comprising the regulating surface 56. The regulating member 53 may be disposed upstream of a contact portion between the pickup roller 51 and the separation pad 57 in the sheet feeding direction. When a stack of sheets is placed on the sheet supply tray 3, the regulating surface 56 may contact an upper side of the stack of sheets. When the upper unit 5 is closed, the regulating surface 56 may extend substantially collinearly with a radius of the pickup roller 51 perpendicular to a line extending along the upper surface of the guide 40, i.e., the regulating surface 56 may be disposed on the same position as an apex of the pickup roller 51 in the sheet feeding direction.

Given the structure described herein, the positions of leading ends of the sheets placed in the sheet supply tray 3 may be regulated upstream of the apex of the pickup roller 51 in the sheet feeding direction. Therefore, favorable distance from the leading ends of the sheets to a contact portion between the peripheral surface of the pickup roller 51 and the separation pad 57 may be ensured. Accordingly, the separation pad 57 may exert favorable sheet separation performances. Inclinations of the sheet supply tray 3 and the guide 40 and the position of the pickup roller 51 may be designed such that leading ends of sheets placed on the sheet supply tray 3 may be positioned near an apex of the pickup roller 51, i.e., an intersection point of the peripheral surface of the pickup roller 51 and a radius of the pickup roller 51 perpendicular to a line along the guide 40.

The regulating surface 56 may be positioned upstream of the apex of the pickup roller 51 in the sheet feeding direction.

While the disclosure has been described in detail with reference to the specific embodiment thereof, it would be apparent to those skilled in the art that various changes, arrangements and modifications may be applied therein without departing from the spirit and scope of the disclosure.

For example, in the above embodiment, the holder 71 may comprise the attaching knob 91 and the supporting member 72 may comprise the attaching hole 105. The attaching knob 91 may be inserted into the attaching hole 105 to attach the supporting member 72 onto the holder 71. Nevertheless, the holder 71 may comprise a hole and the supporting member 72 may comprise a knob. The knob of the supporting member 72 may be inserted into the hole of the holder 71 to attach the supporting member 72 onto the holder 71.

In the above embodiment, the separation pad 57 may have the hole 113. The holder 71 may comprise the knob 90. The knob 90 may be inserted into the hole 113 to prevent the separation pad 57 from coming off from the holder 71. Nevertheless, the separation pad 57 may comprise a knob. The holder 71 may have a hole. The knob of the separation pad 57 may be inserted into the hole of the holder 71 to prevent the separation pad 57 from coming off from the holder 71.

As depicted in FIG. 6, a space may be disposed between an end of the base end opposing portion 103 of the supporting member 72 on the rear side and an end of the protrusion 82 of the holder 71 on the rear side. Nevertheless, each end of the base end opposing portion 103 in the lateral direction may be extended toward the rear side in alignment with or over the respective end of the protrusion 82 on the rear side. Given the structure described herein, a leading end of a sheet might not be folded by contact with the protrusions 82.

As depicted in broken lines in FIG. 8, each protrusion 82 may comprise a substantially semicircular rib 141 on a surface that may be opposed to the separation pad 57. Thus, the separation pad 57 might not make surface contact with each protrusion 82. Consequently, noises attributable to vibration of the separation pad 57 when sheets are separated by the separation pad 57, i.e., noises caused by repeatedly colliding the separation pad 57 and each protrusion 82, may be reduced.

In the above example embodiment, the image scanner 1 may comprise a sheet feeding device according to one or more aspects of the disclosure. However, in some embodiments, a sheet feeding device may be applied to other devices such as image forming devices, e.g., printers and copiers, that may require a sheet feeding mechanism.

While the disclosure has included various example structures and illustrative embodiments, it will be understood by those skilled in the art that other variations and modifications of the structures and embodiments described above may be made without departing from the scope of the disclosure. Other structures and embodiments will be apparent to those skilled in the art in consideration of the specification or practice of the embodiments disclosed herein. It is intended that the specification and the described examples are illustrative.

What is claimed is:

1. A sheet feeding device comprising:

a tray comprising a sheet placing portion configured to receive a sheet;

a roller configured to feed the sheet from the sheet placing portion in a feeding direction; and a separation unit configured to contact with a peripheral surface of the roller, the separation unit comprising:

a separation pad configured to separate sheets one by one by making the sheets contact with a nip portion of the separation pad, the separation pad comprising:

a supported portion including a receding part of a base end of the separation pad; and two slits extending from the base end to interpose the supported portion therebetween;

a holder configured to hold the separation pad; and a supporting member configured to keep the base end of the separation pad connected to the holder, the supporting member comprising an attaching portion configured to attach the supporting member to the holder and a holding portion configured to fit in the supported portion to hold the supported portion in cooperation with the holder.

2. The sheet feeding device according to claim 1, further comprising:

a regulating member comprising a regulating surface, the regulating member being disposed upstream of a contact portion between the roller and the separation unit in the feeding direction, the regulating surface being configured to regulate a number of sheets that contact the separation pad, when a stack of sheets is placed on the tray, wherein the regulating surface is disposed on the same position as or upstream in the feeding direction of an intersection point of the peripheral surface of the roller and a radius of the roller perpendicular to a line extending along the sheet placing portion of the tray, and the attaching portion of the supporting member comprises a base end opposing portion configured to oppose a surface of the base end of the separation pad, and the base end opposing portion being positioned on the same position as or downstream in the feeding direction of the regulating surface.

3. The sheet feeding device according to claim 1, wherein the holder comprises a holder surface configured to oppose a surface of the separation pad opposite to the nip portion, the holder surface having a recess in which the supported portion fits.

4. A separation unit comprising:

a separation pad configured to separate sheets one by one by making the sheets contact with a nip portion of the separation pad, the separation pad comprising;

a supported portion including a receding part of a base end of the separation pad; and two slits extending from the base end to interpose the supported portion therebetween;

a holder configured to hold the separation pad; and a supporting member configured to keep the base end of the separation pad connected to the holder, the supporting member comprising an attaching portion configured to attach the supporting member to the holder and a holding portion configured to fit in the supported portion to hold the supported portion in cooperation with the holder.

5. The separation unit according to claim 4, wherein the holder comprises a holder surface configured to oppose a surface of the separation pad opposite to the nip portion, the holder surface having a recess in which the supported portion fits.

6. The separation unit according to claim 4, wherein the supported portion has a hole formed therethrough and the holder comprises a knob configured to be inserted into the hole.

7. The separation unit according to claim 4, wherein the holder comprises a holder surface configured to be opposed to a surface of the separation pad opposite to the nip portion, the holder surface having a recess in which the supported portion fits; and wherein the supported portion has a hole formed therethrough and the holder comprises a knob configured to be inserted into the hole.

8. The separation unit according to claim 4, wherein the holder comprises a pair of side portions each comprising a side surface perpendicular to a lateral direction of the separation pad and an attaching knob that protrudes outward in the lateral direction from the side surface, the attaching portion of the supporting member comprises a pair of side opposing portions configured to be opposed to the respective side portions from outside in the lateral direction, and each of the side opposing portions has an attaching hole configured to be inserted over the attaching knob.

9. The separation unit according to claim 4, wherein the attaching portion of the supporting member comprises a base end opposing portion configured to oppose a surface of the base end of the separation pad, and the holder comprises a protrusion that protrudes from a side portion of the holder toward the separation pad, the protrusion being interposed between the separation pad and the base end opposing portion.

10. The separation unit according to claim 9, wherein a boundary between the separation pad and the protrusion is exposed from a side of the separation pad including the nip portion.

11. The separation unit according to claim 4, wherein the holding portion has a semicircular shape curving convexly toward an end of the separation pad opposite to the base end.

12. A separation unit comprising:

a separation pad configured to separate sheets one by one by making the sheets contact with a nip portion of the separation pad, the separation pad comprising a supported portion including a receding part of a base end of the separation pad;

a holder configured to hold the separation pad, wherein the holder comprises a holder surface configured to oppose a surface of the separation pad opposite to the nip portion, the holder surface having a recess in which the supported portion fits; and a supporting member configured to keep the base end of the separation pad connected to the holder, the supporting member comprising an attaching portion configured to attach the supporting member to the holder and a holding portion configured to fit in the supported portion to hold the supported portion in cooperation with the holder.

* * * * *